US006913096B1

(12) United States Patent
Nielsen et al.

(10) Patent No.: US 6,913,096 B1
(45) Date of Patent: Jul. 5, 2005

(54) TOP DRIVE WELL DRILLING APPARATUS

(76) Inventors: Shawn James Nielsen, 3 Miller Avenue, Spruce Grove, Alberta (CA) T7X 2L9; Sinisa Dobrijevic, 252 Thorncliff Place, Edmonton, Alberta (CA) T5T 0A2

( * ) Notice: Subject to any disclaimer, the term of this patent is extended or adjusted under 35 U.S.C. 154(b) by 0 days.

(21) Appl. No.: 10/403,972

(22) Filed: Mar. 28, 2003

(30) Foreign Application Priority Data

Jul. 3, 2002 (CA) ..... 2390365

(51) Int. Cl.[7] ..... E21B 19/00
(52) U.S. Cl. ..... 175/85; 166/77.51
(58) Field of Search ..... 175/52, 85; 166/77.51, 166/77.52, 85.1

(56) References Cited

U.S. PATENT DOCUMENTS

| | | | | |
|---|---|---|---|---|
| 4,325,691 A | | 4/1982 | Evans et al. | 431/190 |
| 4,421,179 A | | 12/1983 | Boyadjieff | 173/44 |
| 4,458,768 A | | 7/1984 | Boyadjieff | 175/85 |
| 4,605,077 A | | 8/1986 | Boyadjieff | 175/85 |
| 4,813,498 A | * | 3/1989 | Lynch et al. | 175/113 |
| 5,107,940 A | * | 4/1992 | Berry | 175/85 |
| 5,755,289 A | | 5/1998 | Angman et al. | 166/378 |
| 6,199,641 B1 | | 3/2001 | Downie et al. | 173/55 |
| 6,679,333 B2 | * | 1/2004 | York et al. | 166/379 |
| 2003/0051883 A1 | * | 3/2003 | Seneviratne | 166/380 |
| 2003/0111233 A1 | * | 6/2003 | Pietras | 166/380 |
| 2004/0011531 A1 | * | 1/2004 | Pietras | 166/379 |

OTHER PUBLICATIONS

Testco Incorporated product information sheets, printed from the Internet, 5 pages, undated.
Tesco Corporation product information sheet, printed from the Internet, 1 page, May 3, 2001.
Varco Systems Products information sheet, printed from the Internet, 1 page, May 3, 2001.

* cited by examiner

*Primary Examiner*—William Neuder
(74) *Attorney, Agent, or Firm*—Davis & Bujold, P.L.L.C.

(57) ABSTRACT

A top drive well drilling apparatus includes a body with means for suspending the body from a drilling rig. A motor is secured to the body. The motor has a central passage defining a rotational axis. The central passage is adapted to receive a tubular drive shaft. A pipe gripping assembly is provided which underlies and is in axial alignment with the central passage. The pipe gripping assembly rotates independent of the motor for purposes of orientation.

8 Claims, 8 Drawing Sheets

TOP DRIVE WELL DRILLING APPARATUS

FIELD OF THE INVENTION

The present invention relates to a top drive well drilling apparatus.

BACKGROUND OF THE INVENTION

Examples of top drive well drilling apparatus are illustrated in U.S. Pat. Nos. 4,421,179; 4,458,768; and 4,605,077. These top drive systems use a motor in combination with a gear housing. The motor rotates an output shaft. A pinion gear is mounted on a lower end of the output shaft. This pinion gear is engagable with a large diameter ring gear which is disposed in the gear housing. A tubular driven shaft, to which sections of pipe may be attached, is secured to and rotates with the ring gear.

SUMMARY OF THE INVENTION

The present invention relates to an alternative configuration of top drive well drilling apparatus.

According to the present invention there is provided a top drive well drilling apparatus which includes a body with means for suspending the body from a drilling rig. A motor is secured to the body. The motor has a central passage defining a rotational axis. The central passage is adapted to receive a tubular drive shaft. A pipe gripping assembly is provided which underlies and is in axial alignment with the central passage. Means is provided for rotating the pipe gripping assembly independent of the motor for purposes of orientation.

The top drive well drilling apparatus, as described above, eliminates the need for a gearbox while increasing both torque and rotational speed.

Although beneficial results may be obtained through the use of the invention, as described above, even more beneficial results may be obtained by the addition of preferred features as will hereinafter be further described.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
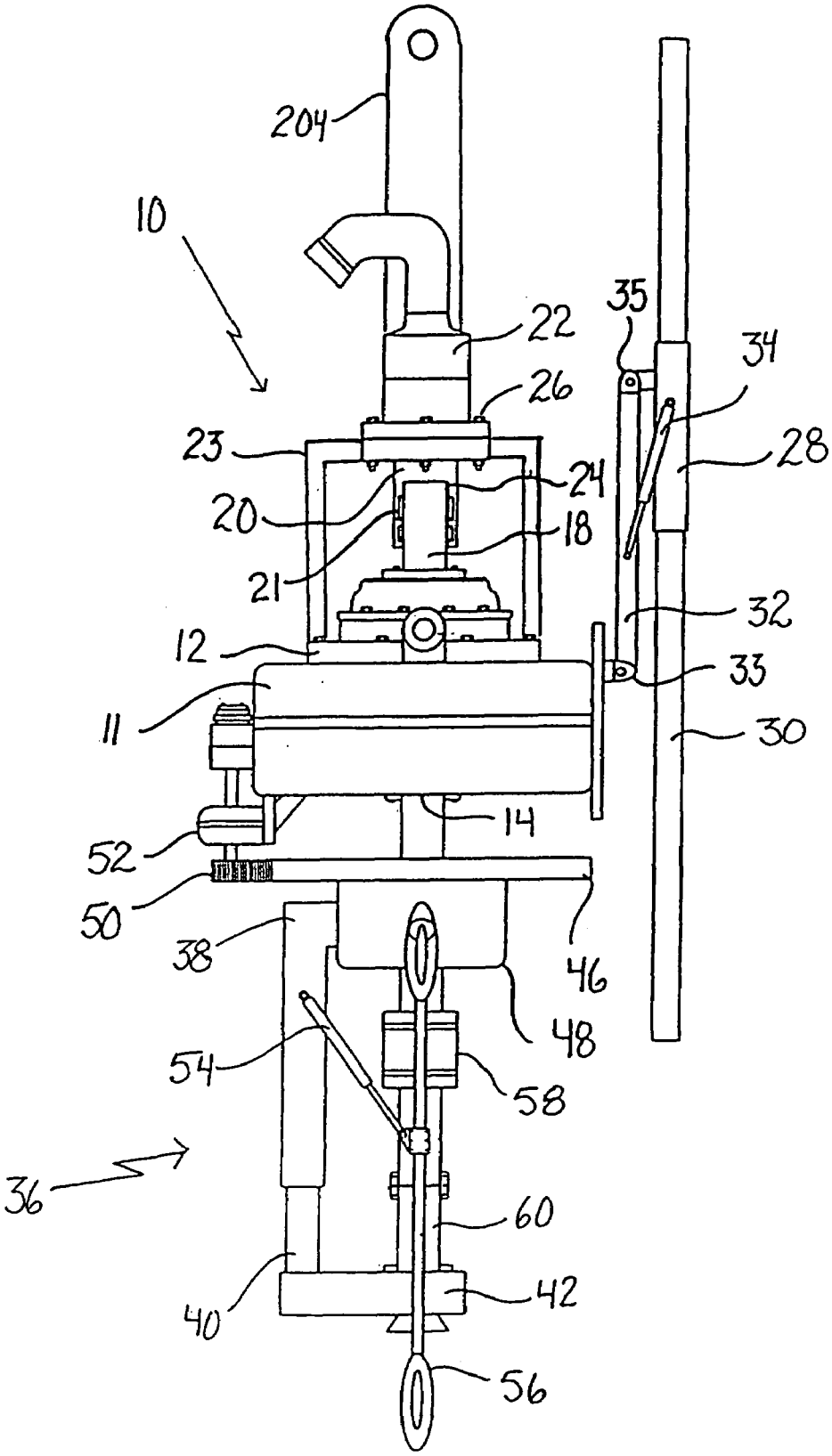
FIG. 1 is a side elevation view of a top drive drilling apparatus constructed in accordance with the teachings of the present invention.

The preferred embodiment, a top drive well drilling apparatus generally identified by reference numeral 10, will now be described with reference to FIGS. 1 through 7.

Figure 2:
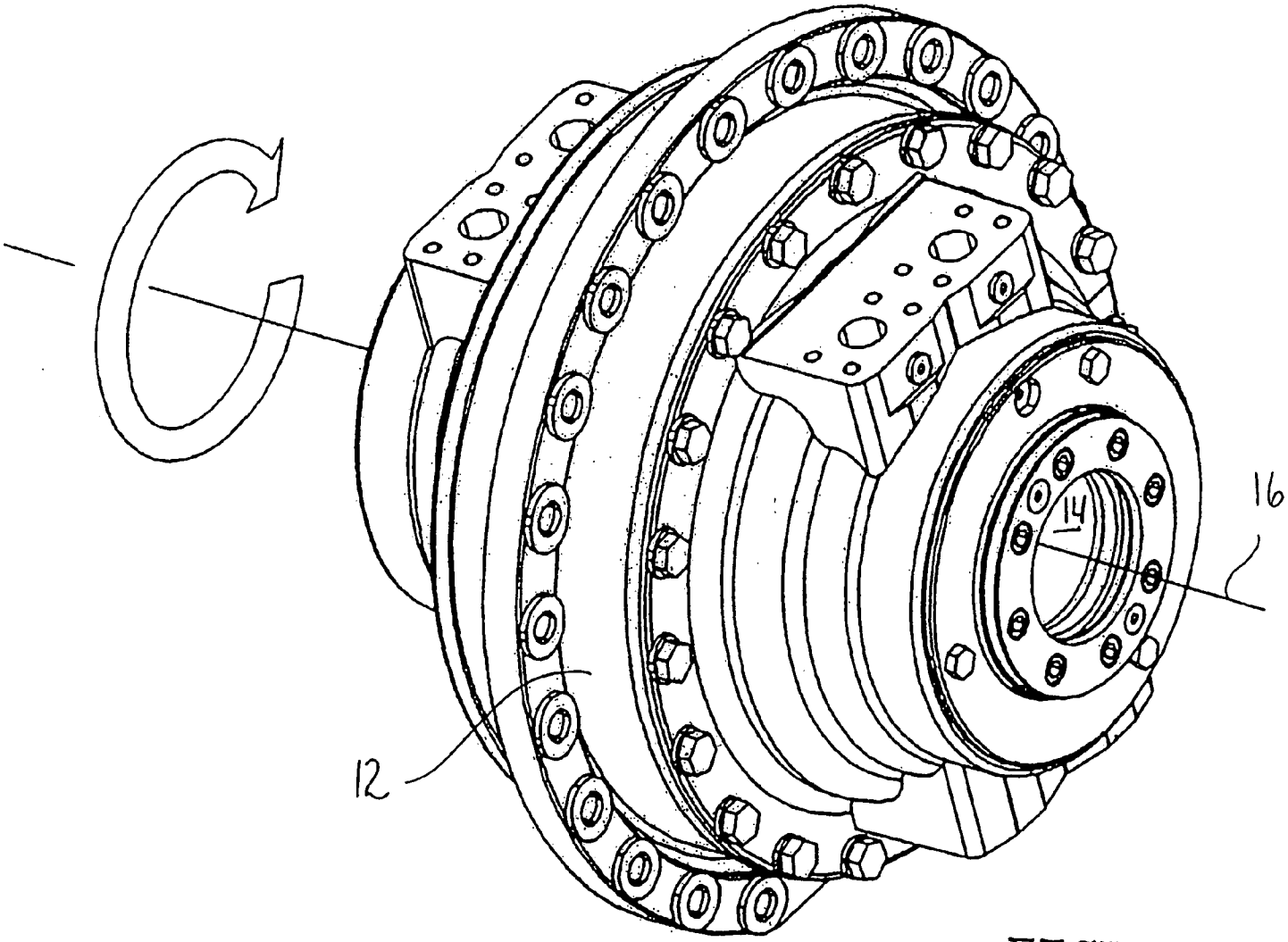
FIG. 2 is a perspective view of an annular motor from the top drive drilling apparatus illustrated in FIG. 1.
Figure 5:
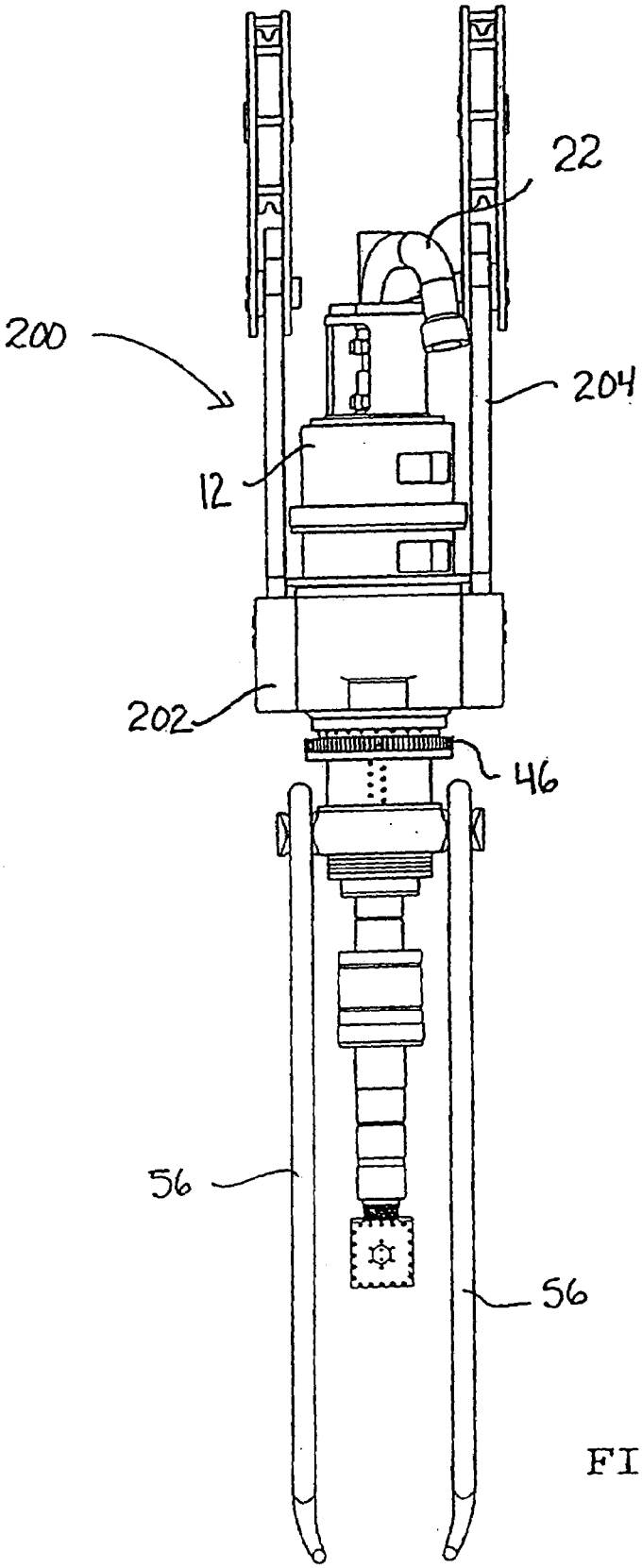
FIG. 5 is a front elevation view of a reinforced version of the top drive drilling apparatus constructed in accordance with the teachings of the present invention.
Figure 7:
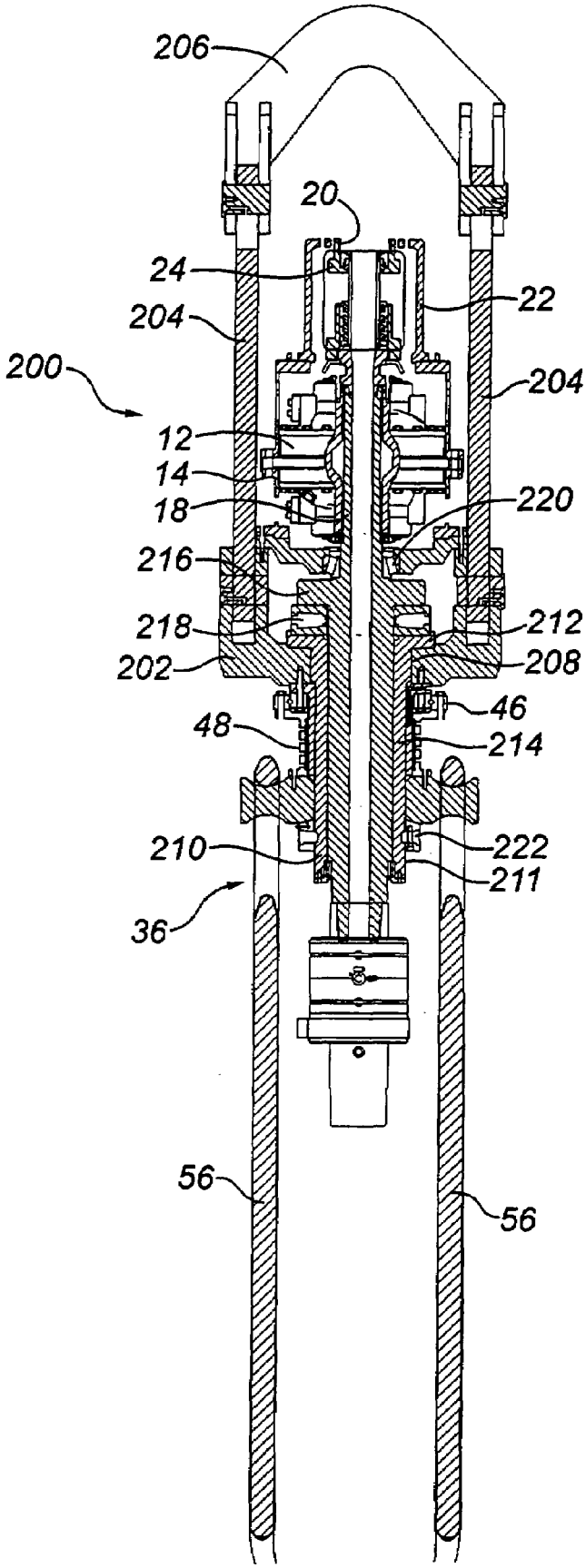
FIG. 7 is a front elevation view, in section, of the reinforced top drive drilling apparatus illustrated in FIG. 5.

Structure and Relationship of Parts:

Referring to FIG. 1, there is provided a top drive well drilling apparatus 10 which includes a body 11. Referring to FIGS. 5 and 7, body 11 has arms 204. One of arms 204 have been left off of FIG. 1, so as not to obscure the view of other features. Referring to FIG. 7, a coupling is secured to arms 204 to adapt body 11 to be suspended from a drilling rig. In the illustrated embodiment the coupling is in the form of a hook receiver 206 which enables body 11 to be suspended by a hook from the travelling blocks of the drilling rig. A motor 12 is secured to body 11. Referring to FIG. 2, motor 12 has a central passage 14 that defines a rotational axis 16. Referring to FIG. 1, central passage 14 is adapted to receive a tubular drive shaft 18. A stationary gooseneck connector 22 is mounted to a stationary support frame 23 by bolts 26. Stationary support frame 23 is secured to motor 12. A stationary washpipe assembly 20 communicates with gooseneck connector 22. Washpipe assembly 20 receives first end 24 of drive shaft 18. First end 24 of drive shaft 18 freely rotates within washpipe assembly 20. A series of seals 21 are disposed between first end 24 of drive shaft 18 and washpipe assembly 20 to prevent leakage of fluids.

Figure 3:
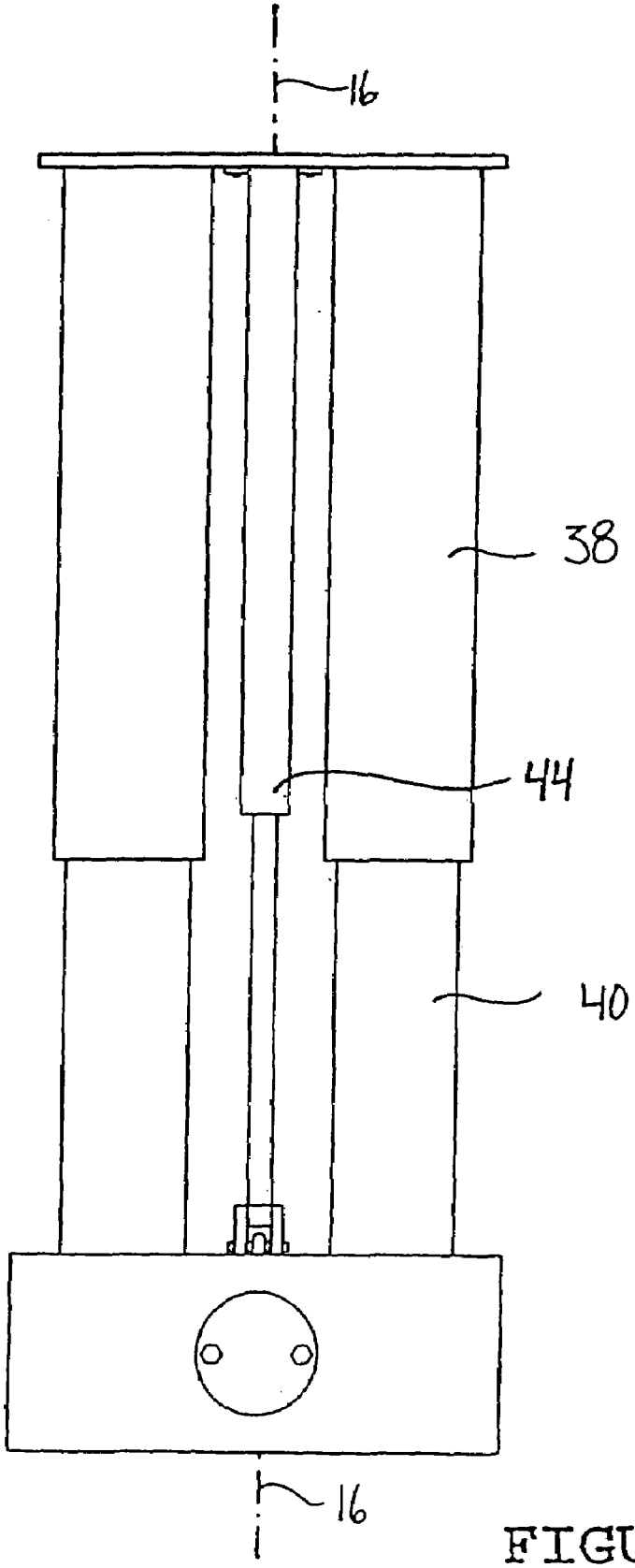
FIG. 3 is a back elevation view of a telescopic pipe gripping assembly from the top drive drilling apparatus illustrated in FIG. 1.

A pipe gripping assembly, generally referenced by numeral 36 is positioned in axial alignment with central passage 14. Pipe gripping assembly 36 includes a first body 38 and a second body 40. Pipe jaws 42 are mounted on second body 40. Referring to FIG. 3, second body 40 is telescopically extendible relative to first body 38 to vary the positioning of pipe jaws 42 axially along rotational axis 16. A second fluid actuated extendible cylinder 44 is provided to maintain second body 40 in a selected telescopic position. Referring to FIG. 1, a ring gear 46 and bearing gear carrier 48 are positioned on first body 38 of pipe gripping assembly 36. A pinion gear 50 that is rotated by an auxiliary motor 52 engages ring gear 46 to rotate pipe gripping assembly 36 independent of annular motor 12 for the purpose of orienting pipe jaws 42. A third fluid actuated extendible cylinder 54 is provided on first body 38 for adjusting the positioning of a bail 56 that is pivotally attached to bearing gear carrier 48. A mud saver 58 and saver sub 60 are provided on drive shaft 18.

Figure 4:
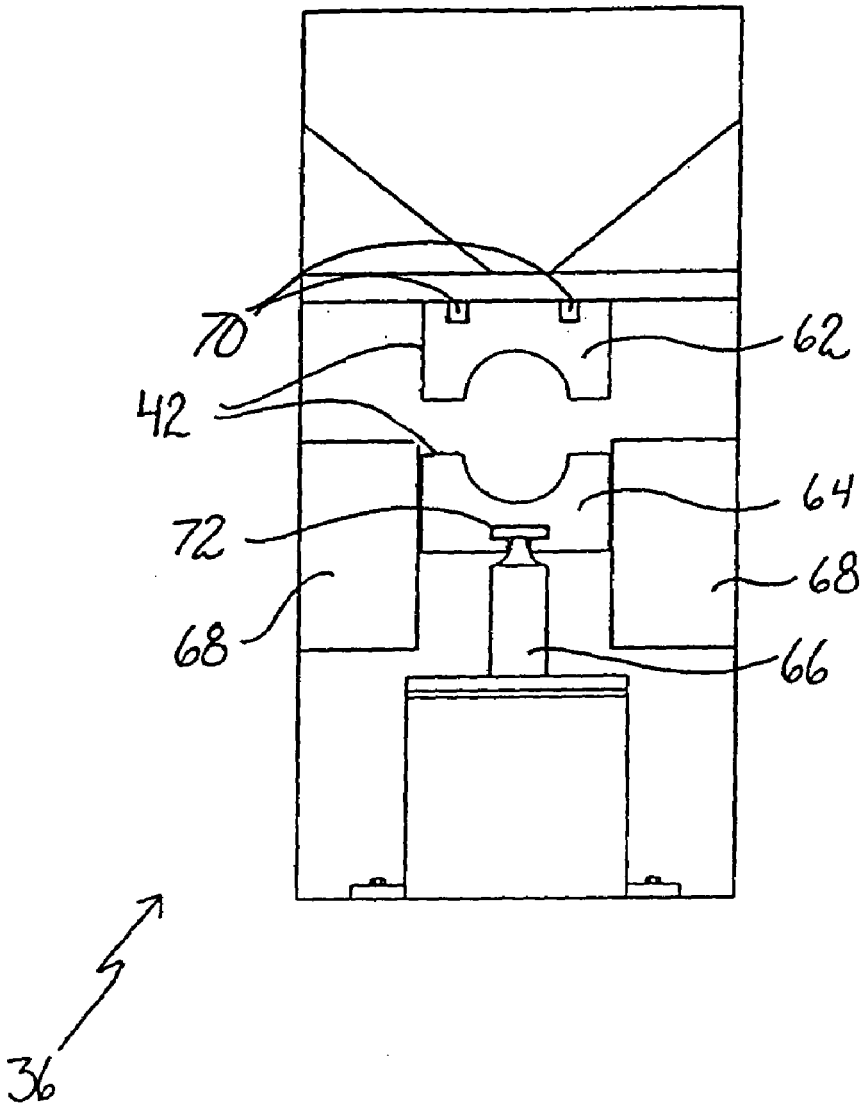
FIG. 4 is a top plan view, in section, of the telescopic pipe gripping assembly from the top drive drilling apparatus illustrated in FIG. 3.

Referring to FIG. 4, pipe jaws 42 have a first pipe engaging portion 62 and a second pipe engaging portion 64. First portion 62 is stationary, while second portion 64 is moved relative to first portion 62 by a fourth fluid actuated extendible cylinder 66 such that first portion 62 and second portion 64 are able to engage a pipe. Guide blocks 68 are provided for maintaining second portion 64 in alignment with first portion 62. First portion 62 is secured to pipe gripping assembly 36 by a slotted engagement 70 to facilitate replacement of first portion 62 when necessary. Second portion 64 is secured to fourth extendible cylinder 66 by a slotted engagement 72 to facilitate replacement of second portion 64 when necessary.

Referring to FIG. 1, a travel member 28 is provided that moves along a substantially vertical track 30 which is adapted to be mounted to a drilling rig. A torque restraint arm 32 is provided having a first end 33 and a second end 35. First end 33 is pivotally secured to body 11. Second end 35 is pivotally secured to travel member 28. Torque restraint arm 32 is angularly adjustable by a first fluid actuated extendible cylinder 34. This enables pipe gripping assembly to be moved laterally so that pipe jaws 42 can engage pipe positioned in a mousehole of the drilling rig.

Operation:

The use and operation of top drive well drilling apparatus 10 will now be described with reference to FIGS. 1 though 4. Referring to FIG. 1, top drive well apparatus 10, as described above, eliminates the need for a gearbox while increasing both torque and rotational speed. Body 11 is suspended from a drilling rig. Motor 12 is activated to rotate drive shaft 18 and attached drill string. As additional pipe sections are required to be added to drill string, pipe gripping assembly 36 is used to engage additional sections of pipe.

In order to obtain an additional section of pipe from the mousehole, first extendible cylinder 34 is used to adjust the angular positioning of arm 32. Pivotally mounted arm 32 has a span of approximately 5 feet which allows for top drive well apparatus 10 to be moved laterally toward the mousehole and back into a central position.

In order to place pipe jaws 42 is the correct orientation to engage the pipe from the mousehole, auxilliary motor 52 is used to orientate pipe gripping assembly 36. Auxiliary motor 52 rotates pinion gear 50 which in turn rotates ring gear 46 to rotate pipe gripping assembly 36 independent of annular motor 12.

In order to engage the pipe from the mousehole, second extendible cylinder 44 is activated to move second body 40 relative to first body 38 to vary the position of pipe jaws 42 axially along rotational axis 16 and thereby properly position the section of pipe. Fourth extendible cylinder 66 is then activated to move second portion 64 of pipe jaws 42 toward stationary first portion 62 of pipe jaws 42 to grip the section of pipe below its joint collar.

Figure 6:
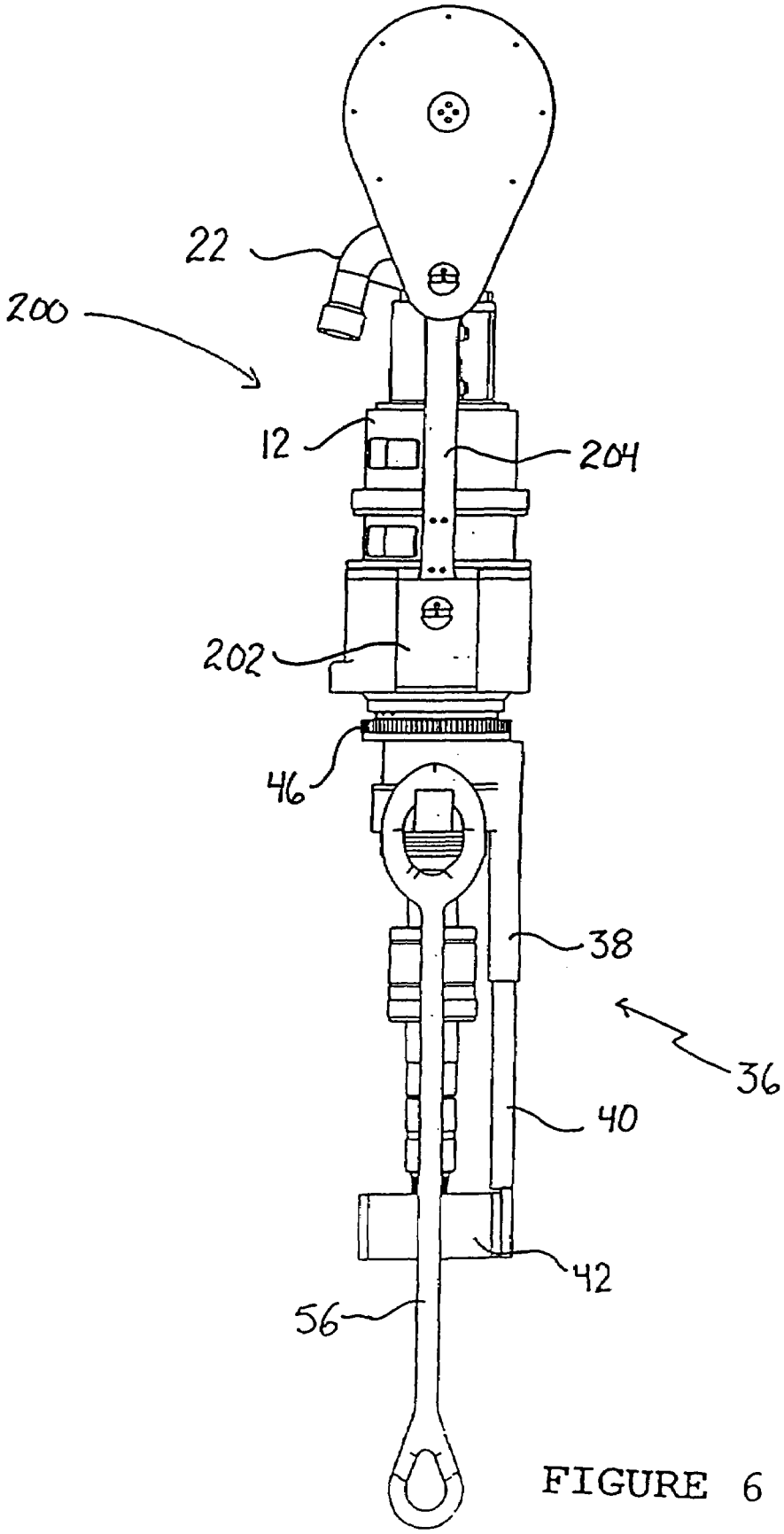
FIG. 6 is a side elevation view of the reinforced top drive drilling apparatus illustrated in FIG. 5.

Variations:

Referring to FIGS. 5 through 7, there is illustrated a reinforced version of top drive drilling apparatus 10, which is generally identified by reference numeral 200. The components of this version of top drive drilling apparatus 10 will be identified by the same reference numerals as used in the description above, so that only the differences need to be identified and specifically described. Referring to FIG. 7, main body 202 of top drive drilling apparatus 200 has arms 204 to which is attached a hook receiver 206. Main body 202 has an opening 208 in which a swivel sleeve 210 is suspended by engagement shoulders 212. A quill 214 is forms as an extension of drive shaft 18. Quill 214 is suspended within swivel sleeve 210 by engagement shoulders 216. Ring gear 46 and bearing gear carrier 48 are rotatably mounted to exterior surface 211 of swivel sleeve 210.

A thrust bearing 218 is disposed between engagement shoulders 212 of swivel sleeve 210 and engagement shoulders 216 of quill 214 to withstand axial loading upon quill 214. Radial bearings 220 are disposed between drive shaft 18 and main body 202 to withstand radial loading. When a load is hanging from quill 214, the load is transmitted by engagement shoulders 216 of quill 214 via thrust bearing 218 to engagement shoulders 212 of sleeve 210. The load is then transferred from engagement shoulders 212 of sleeve 210 to main body 202. A load nut 222 is secured to sleeve 210 and plays a role when top drive drilling unit 200 is used tripping pipe with elevators. With top drive drilling apparatus 10, problems were experienced with failure of the quill. The quill was experiencing excessive loading in the vicinity of the load nut when pulling up under load. In order to address this problem, attempts were made to reinforce the quill. However, reinforcing the quill inevitably resulted in the fluid path through the quill being narrowed. These problems with failure of the quill were addressed in the embodiment illustrated in FIG. 7, by having load nut 222 secured directly onto exterior surface 211 of sleeve 210.

Figure 8:
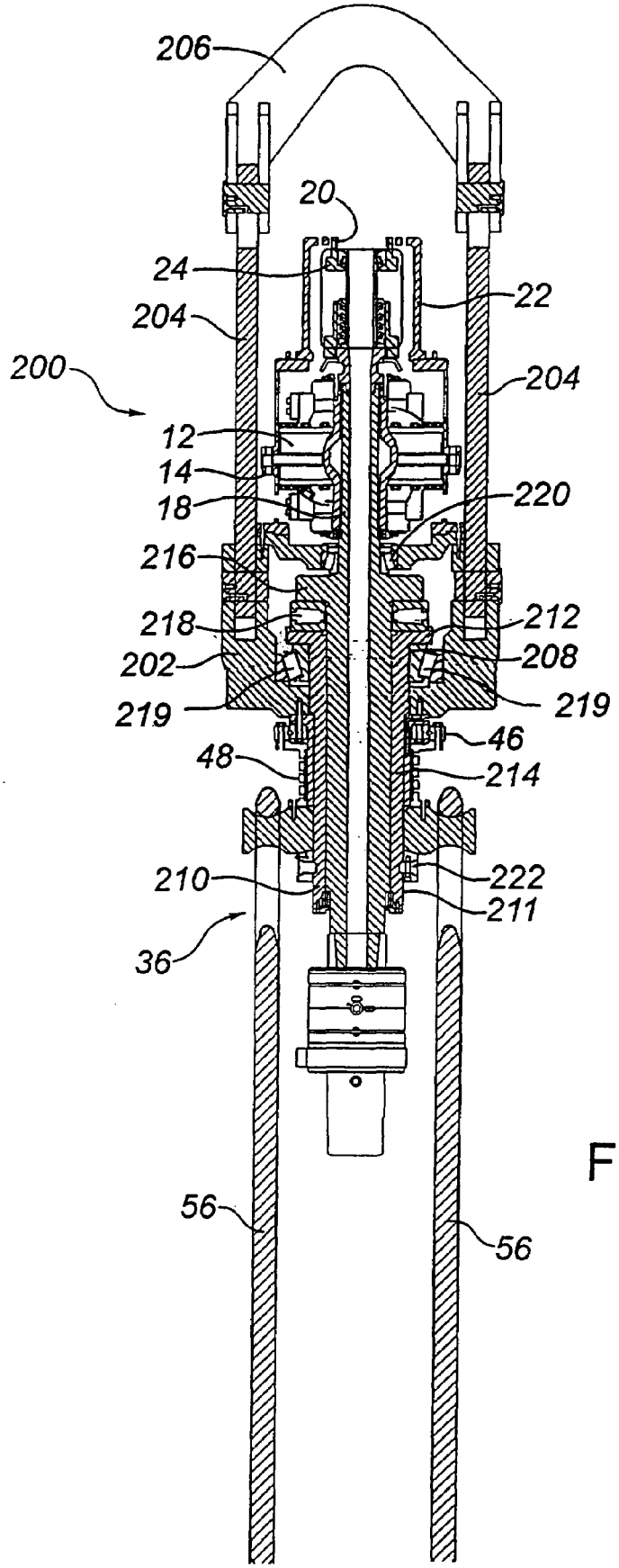
FIG. 8 is a front elevation view, in section, of a modified version of the reinforced top drive drilling apparatus illustrated in FIG. 5.

As a result of field experience with the top drive drilling apparatus, there is a modification that is recommended. Referring to FIG. 8, it is recommended that an additional bearing 219 be inserted between engagement shoulders 212 of sleeve 210 and main body 202. Bearing 219 facilitates rotation of sleeve 210 relative to main body 202, in order to alter the rotational positioning of bails 56.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

What is claimed is:

1. A top drive well drilling apparatus comprising:

a body with means for suspending the body from a drilling rig;

a motor secured to the body, the motor having a central passage defining a rotational axis, the central passage being adapted to receive a tubular drive shaft;

a pipe gripping assembly which underlies and is in axial alignment with the central passage; and means for rotating the pipe gripping assembly independent of the motor for orientation of the pipe gripping assembly;

means being provided for moving the body laterally whereby the pipe gripping assembly can be moved into engagement with a pipe in a mouse hole of the drilling rig; and the means for moving the body laterally including a travel member which moves substantially vertically up and down the drilling rig, a torque restraint arm being pivotally mounted to the travel member and pivotally mounted to the body, the torque restraint arm being angularly adjustable by means of a first fluid actuated extendible cylinder, thereby moving the body laterally.

2. A top drive well drilling apparatus comprising:

a body with means for suspending the body from a drilling rig;

a motor secured to the body, the motor having a central passage defining a rotational axis, the central passage being adapted to receive a tubular drive shaft;

a pipe gripping assembly which underlies and is in axial alignment with the central passage; and means for rotating the pipe gripping assembly independent of the motor for orientation of the pipe gripping assembly, and the means for rotating the pipe gripping assembly including a ring gear on the pipe gripping assembly which is driven by a pinion gear rotated by an auxiliary motor.

3. The apparatus as defined in claim 2, wherein the pipe gripping assembly includes pipe jaws, the pipe gripping assembly being telescopically adjustable to vary the positioning of the pipe jaws axially along the rotational axis, means being provided to maintain the pipe gripping assembly in a selected telescopic position.

4. A top drive well drilling apparatus comprising:

a body with means for suspending the body from a drilling rig;

a motor secured to the body, the motor having a central passage defining a rotational axis, the central passage being adapted to receive a tubular drive shaft;

a pipe gripping assembly which underlies and is in axial alignment with the central passage; and means for rotating the pipe gripping assembly independent of the motor for orientation of the pipe gripping assembly, the body having an opening, a swivel sleeve being suspended in the opening of the body by a first engagement shoulder, a quill forming an extension of the drive shaft, the quill being suspended within the swivel sleeve by a second engagement shoulder, and a load nut being secured to the sleeve.

5. The apparatus as defined in claim 4, wherein a thrust bearing is disposed between the first engagement shoulder of swivel sleeve and the second engagement shoulder of the quill to withstand axial loading upon the quill.

6. The apparatus as defined in claim 4, wherein a bearing is disposed between the first engagement shoulder of the swivel sleeve and the main body, thereby facilitating rotation of the swivel sleeve relative to the main body.

7. A top drive well drilling apparatus, comprising:

a body having an opening, a swivel sleeve being suspended in the opening of the body by a first engagement shoulder with a load nut being secured to the sleeve;

a hook receiver on the body, the hook receiver being adapted to be engaged with a hook carried by traveling blocks on a drilling rig;

a motor secured to the body, the motor having a central passage defining a rotational axis, the central passage being adapted to receive a tubular drive shaft;

a quill forming an extension of the drive shaft, the quill being suspended within the swivel sleeve by a second engagement shoulder;

a thrust bearing disposed between the first engagement shoulder of swivel sleeve and the second engagement shoulder of the quill to withstand axial loading upon the quill;

a pipe gripping assembly which underlies and is in axial alignment with the central passage, the pipe gripping assembly including pipe jaws and being telescopically adjustable to vary the positioning of the pipe jaws axially along the rotational axis in a selected telescopic position, the pipe gripping assembly having a ring gear;

an auxiliary motor having a pinion gear which engages the ring gear on the pipe gripping assembly, thereby rotating the pipe gripping assembly independent of the motor for purposes of orientation of the pipe gripping assembly;

a travel member adapted for mounting to a drilling rig, such that the travel member moves substantially vertically up and down the drilling rig;

a torque restraint arm having a first and pivotally mounted to the travel member and a second end pivotally mounted to the body; and a first fluid actuated extendible cylinder acting to angularly adjust the torque restraint arm, thereby moving the body laterally so that the pipe gripping assembly can be moved into engagement with a pipe in a mouse hole of the drilling rig.

8. The apparatus as defined in claim 7, wherein a bearing is disposed between the first engagement shoulder of the swivel sleeve and the main body, thereby facilitating rotation of the swivel sleeve relative to the main body.

* * * * *